US007100348B2

(12) United States Patent
Mertens

(10) Patent No.: US 7,100,348 B2
(45) Date of Patent: Sep. 5, 2006

(54) CONTINUOUS STRIP OF DETACHABLY INTERCONNECTED FOLDED PRODUCTS

(75) Inventor: Luc Mertens, Aalst (BE)

(73) Assignees: Megaspirea N.V., Aalst (BE); Hersch Reich, Antwerp (BE)

( * ) Notice: Subject to any disclaimer, the term of this patent is extended or adjusted under 35 U.S.C. 154(b) by 8 days.

(21) Appl. No.: 10/445,798

(22) Filed: May 28, 2003

(65) Prior Publication Data

US 2004/0016210 A1 Jan. 29, 2004

Related U.S. Application Data

(60) Division of application No. 09/426,638, filed on Oct. 25, 1999, now abandoned, which is a continuation-in-part of application No. 08/913,051, filed as application No. PCT/BE96/00023 on Mar. 6, 1996, now Pat. No. 5,971,260.

(51) Int. Cl.
*B65B 11/48* (2006.01)

(52) U.S. Cl. ..... 53/460; 53/569; 53/206; 493/216; 493/917

(58) Field of Classification Search ..... 53/460, 53/569, 206, 284.3; 493/216, 375, 378, 917, 493/961

See application file for complete search history.

(56) References Cited

U.S. PATENT DOCUMENTS

| | | | | | |
|---|---|---|---|---|---|
| 1,801,155 | A | * | 4/1931 | Harson | 229/92.1 |
| 2,464,490 | A | | 3/1949 | Davies | |
| 2,610,784 | A | | 9/1952 | Henry | |
| 2,776,085 | A | | 1/1957 | Furey | |
| 2,783,935 | A | * | 3/1957 | Mercur | 229/69 |
| 3,028,069 | A | | 4/1962 | Willis | |
| 3,228,586 | A | * | 1/1966 | Hayes, Jr. | 229/305 |
| 3,332,604 | A | | 7/1967 | Whitman | |
| 3,557,519 | A | | 1/1971 | Lyon, Jr. | |
| 3,559,875 | A | | 2/1971 | Wilson | |
| 3,626,821 | A | | 12/1971 | Gendron | |
| 3,790,068 | A | | 2/1974 | Stutz | |
| 3,897,720 | A | * | 8/1975 | Hiersteiner | 493/216 |
| 3,980,006 | A | * | 9/1976 | Welch | 493/238 |
| 3,998,138 | A | * | 12/1976 | Walters | 493/233 |
| 4,063,398 | A | * | 12/1977 | Huffman | 53/412 |
| 4,066,206 | A | | 1/1978 | Peterson | |
| 4,091,987 | A | * | 5/1978 | Cone | 229/69 |
| 4,437,852 | A | | 3/1984 | Volk, Jr. et al. | |
| 4,454,980 | A | * | 6/1984 | Poehler | 229/69 |
| 4,497,509 | A | | 2/1985 | Gore | |
| 4,600,141 | A | | 7/1986 | Bradley et al. | |
| 4,630,768 | A | | 12/1986 | Bradley | |
| 4,651,920 | A | | 3/1987 | Stenner | |
| 4,731,048 | A | | 3/1988 | Marella et al. | |
| 4,804,135 | A | | 2/1989 | Bourbeau | |
| 4,886,205 | A | | 12/1989 | Schnitzer | |
| 4,896,821 | A | | 1/1990 | Bell | |
| 5,069,384 | A | | 12/1991 | Bell | |
| 5,398,867 | A | | 3/1995 | Murphy | |
| 5,971,260 | A | | 10/1999 | Mertens | |

* cited by examiner

*Primary Examiner*—Sameh H. Tawfik
(74) *Attorney, Agent, or Firm*—Browdy and Neimark, PLLC

(57) ABSTRACT

The invention relates to a continuous strip of detachable consecutive interconnected products manufactured by folding, such as envelopes and the like, and to a process for manufacturing the said strip, two of those consecutive products being interconnected through a joint (22) which is not part of the products themselves and links up detachably, through successive lines of demarcation, with each of those two consecutive products in such a way that, on removing this joint (22), the said two consecutive products are entirely separated.

5 Claims, 14 Drawing Sheets

CONTINUOUS STRIP OF DETACHABLY INTERCONNECTED FOLDED PRODUCTS

CROSS-REFERENCE TO RELATED APPLICATIONS

This application is a division of U.S. application Ser. No. 09/426,638, filed Oct. 25, 1999 now abandoned, which was a continuation-in-part of U.S. application Ser. No. 08/913,051, filed Sep. 5, 1997, now U.S. Pat. No. 5,971,260, which was a 371 of PCT/BE96/00023, filed Mar. 6, 1996.

BACKGROUND OF THE INVENTION

1. Technical Field of the Invention

This invention relates to a continuous strip of detachable consecutive interconnected products, obtained through folding, notably envelopes, bags, files, cases, foldable packing material, etc.

2. Prior Art

Continuous strips of detachable envelopes have long been used, as is shown a.o. by the following patent specifications U.S. Pat. No. 4,066,206 (Peterson), FR-A-1,488,888 (Gysin) and GB-A-567,925 (Davies).

Such strips of envelopes, however, hold various disadvantages as to the appearance and the finish of the envelopes, after they have been separated. The said envelopes, for instance, clearly show marks of division lines.

OBJECT AND SUMMARY OF THE INVENTION

The invention inter alia aims at remedying those flaws in a very simple and effective way and at offering a continuous strip of detachable interconnected products, the visible edges of which, for instance, when they are separated, are completely finished in such a way that, as far as finishing and aspect is concerned, they entirely correspond to the ones which are manufactured separately one by one and that they are hardly distinguishable from them, and this, in spite of the envelopes originally being made from a continuous strip, in a somewhat analogous way to the first application set forth in patent GB-A-567925.

To that end, according to the invention, two consecutive products in the continuous strip are interconnected by a joint not being part of the products themselves and being connected, in a detachable way, through successive lines of demarcation, to each of those two consecutive products, in such a way that, on removing the joint, the said two consecutive products are completely severed.

Functionally, at least part of the joints linking the consecutive products can be or are attached to a common carrier in such a way that, together with the carrier, they may be severed from the other products through one single operation.

In a particular application of the continuous strip of consecutive products, a joint piece, according to this invention, if relevant products are being formed from longitudinally consecutive areas of material which are interconnected at least through a folding division line transverse to that direction, extends from the free edge of a so-called end area of a product of that strip to a so-called initial area of material of the consecutive product of the strip.

In a specific application of this invention, if those products consist of envelopes with three successive areas of material constituting, respectively, the closing flap, the front portion and the back portion of an envelope, the closing flap forms the said initial area and the back portion the said end area.

According to a preferred application of the invention, the joints stretch out beyond the products, in such a way that it is possible to print those joints in a similar way to and together with the products which are interconnected through the latter.

The invention also pertains to a process for manufacturing a continuous strip of products produced through folding, consecutive series of areas of material being constituted, which are separated by folding lines transverse to the longitudinal direction of that strip, and two adjacent series of such areas of material being interconnected by division lines through a joint piece, a product out of every series of areas of material being constituted by joining the said areas through folding them round the said folding lines.

BRIEF DESCRIPTION OF THE DRAWINGS

Other particulars and advantages from the invention will be shown in the following description of some specific applications of the strip according to the invention and a process to manufacture them this description is only provided by way of an example and does not restrict the scope of the protection claimed; the numbers referred to hereafter pertain to the corresponding drawings.

FIGS. 51 and 5J show the products as boxes.

DETAILED DESCRIPTION OF THE PREFERRED EMBODIMENT(S) OF THE INVENTION

In the various drawings, the same numbers refer to the same or to analogous elements.

Figure 1:
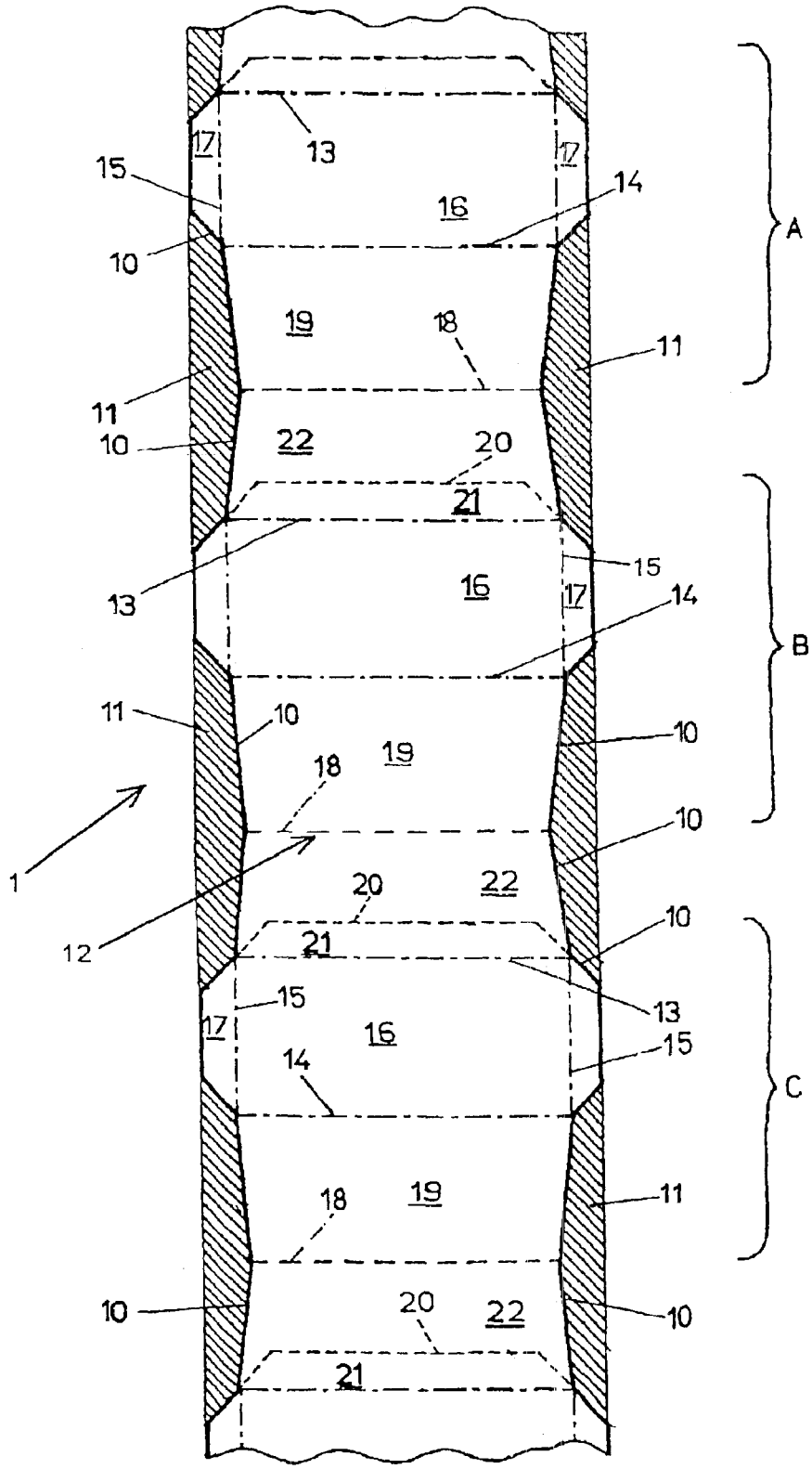
FIG. 1 is a plan view of consecutive series of areas of material.

In order to constitute a strip of consecutive products, in a first application of the invention, a basic form 12 from which envelopes are made, is being cut out of a continuous strip of material 1, preferably a strip of paper, cardboard or plastic, as represented in FIG. 1, along the lines 10 in the longitudinal direction of this strip 1. The hatched zones 11 thus are removed from the sides of the strip 1.

Further, the folding lines 13, 14 and 15 as well as the division lines 18, 20 are applied to~this basic form 12. The folding lines 13 and 14 extend transverse to the length of the strip and right across the width of basic form 12, whereas the folding lines 15 extend along the longitudinal direction of this basic form 12. Folding lines 13, 14 and 15 delineate the front side 16 of an envelope. Folding lines 15 separate sideflaps 17 from this front side 16. Back 19 of an envelope is delineated, on the one hand, by a folding division line 18 and a folding line 14, and, on the other hand, by lines 10 or, accordingly, the longitudinal edge of the basic form 12. Next to front side 16 of an envelope, a closing flap 21 has been provided. This closing flap is delineated by a folding line 13 and a division line 20. Thus, joint piece 22 are constituted, connecting two consecutive envelopes which are delineated by a folding division line 20 and the subsequent folding division line 18.

Consequently, the basicform 12 contains consecutive series of areas of material, each series of those areas being separated by division lines 18, 20.

In each series, the areas are constituted by, successively, a back 19, a front side 16 and a closing flap 21, separated by folding lines 13, 14, 15 which permit the folding of an envelope. Two consecutive series are interconnected by the aforementioned joint piece 22. Thus, a series of three envelopes A, B and C are represented in basic form 12 of FIG. 1.

The folding lines 13, 14, 15 are provided to make the folding easier and more accurate in constituting the envelopes. When the envelopes are machine-made, these folding lines may possibly be left out and the folding of the envelopes requires then but one stage. The forming of the envelopes may therefore take place on the basis of a continuous strip of material, both the aforementioned basic form 12 being cut out and the envelopes being folded and glued all at one stage. The basic form represented in FIG. 1 may therefore show an almost unlimited length.

Figure 2:
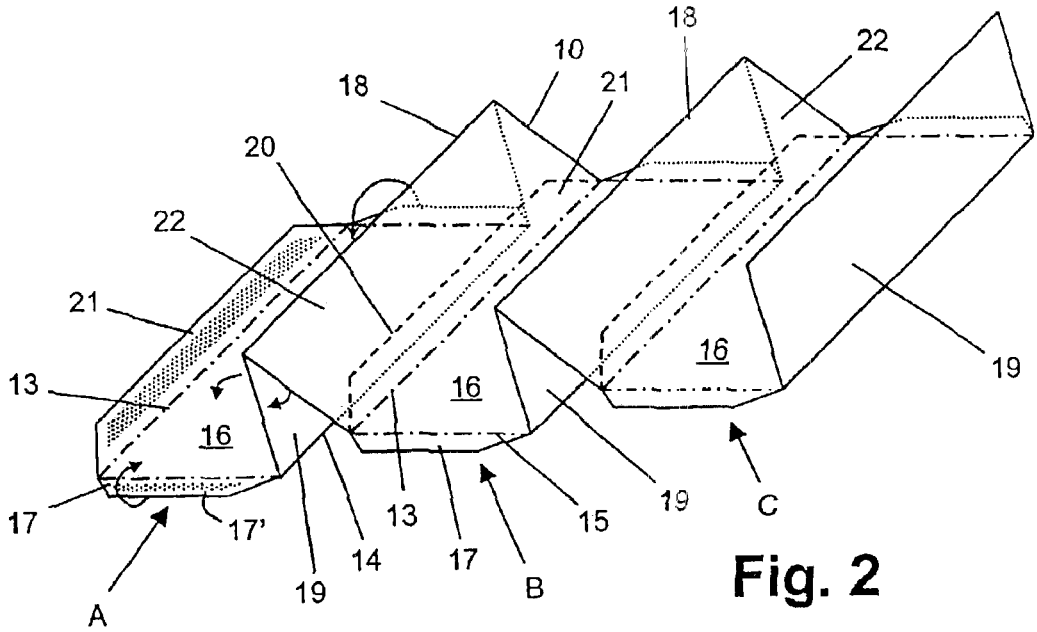
FIG. 2 provides a schematic drawing of how envelopes are formed, according to the invention, from series of areas of material from FIG. 1.

FIG. 2 shows the forming of the envelopes on the basis of a basic form 12 consisting of the series of three envelopes A, B and C. Accordingly, a first envelope is made by folding both side flaps 17 against the corresponding front band 16, around folding line 15. Next, an adhesive 17' is applied to the side of those side flaps 17 turned away from the front side 16. The corresponding back 19 is then folded against the side flaps 17, around folding line 14, in order for back 19 to be attached to side flaps 17.

The outside of the in-turned side flaps 17 and the inside of the in-turned back 19 may also be joined in another way, according to the material used. When folding the back 19 along the lines of the method described above, joint piece 22, following back 19, is folded simply around folding and division line 18, in such a way that this joint piece 22 is now at the side of back 19 which is turned away from front side 16 of the envelope. The other series are folded analogously into envelopes.

The closing flap 21 of an envelope formed from the first series of areas of material of a basic form 12 may be closed or not.

Figure 3:
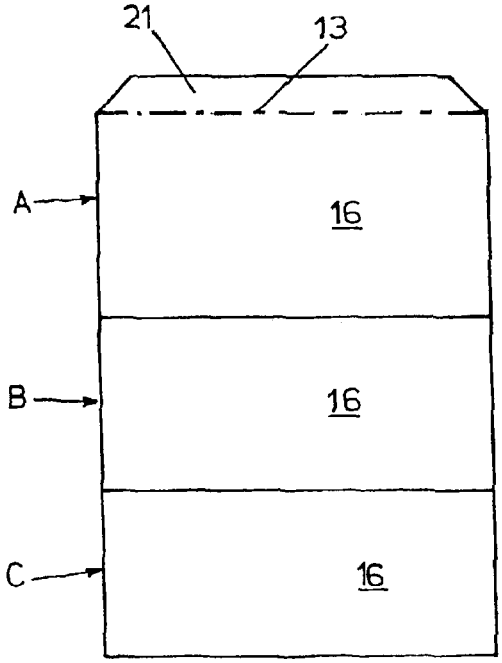
FIG. 3 represents a schematic plan view of a strip with three envelopes according to the invention.
Figure 4:
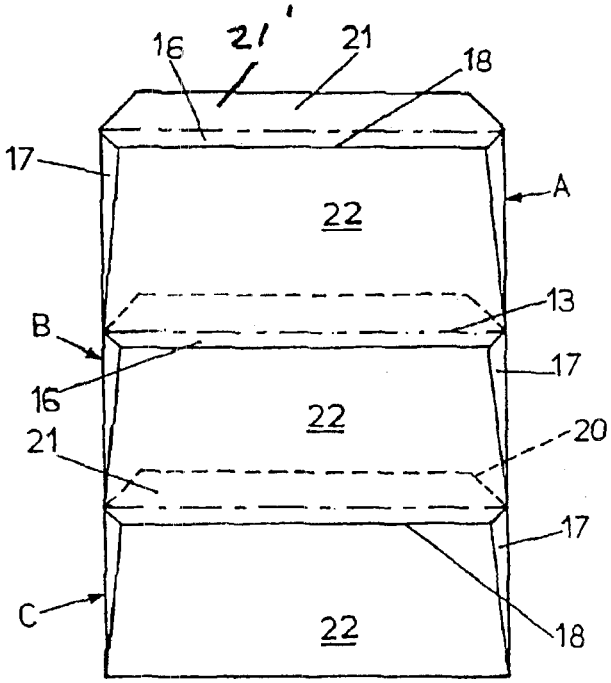
FIG. 4 represents the bottom view of the strip of FIG. 3.

FIG. 3 shows the three front portions 16 and backs 19 of consecutive envelopes A, B and C formed in the above-mentioned manner. In the course of that process, the closing flaps 21 are provided with an adhesive agent 21' allowing to attach the closing flaps 21, after they have been folded around folding line 13, to the corresponding backs 19, in order to close the envelopes.

It is self-evident that basic form 12 for the envelopes may be executed in various types, both for continuous series and for a certain amount of envelopes.

The use of joint pieces 22 is also multifunctional. They may take any form without this affecting the quality of the envelopes. In a special application, for instance, joint pieces 22 in basic form 12 are made sufficiently broad, so that, in a strip of folded envelopes, in addition to the entire closing flaps 21, also part of joint pieces 22 exceeds beyond the front portions 16 of the respective envelopes. Thus, these joint pieces 22 may be printed simultaneously with the envelopes. This application is very useful when a counterfoil has to be preserved as a check of the printed envelopes or for filing purposes. In that way, these joint pieces 22 may constitute such a counterfoil which not only extends from under the envelopes, but which may for instance also be filed, after having been printed simultaneously with the envelopes.

In a very advantageous application of the strip 1, according to the invention, uninterrupted series of envelopes are constituted, the joint pieces 22 being attached to a common carrier on the folding of the envelopes. This carrier may, for instance, be a paper strip which, on folding the envelopes is progressively glued to the joints. This application has the advantage that the joint pieces 22 remain fixed to the carrier, when the envelopes are removed. This mainly holds plus-points in filing the joint pieces 22, when the latter constitute the abovementioned counterfoils. Moreover, the envelopes then may be separated from joint pieces 22 through one single operation, by retaining a number of consecutive envelopes, on the one hand, and the said carrier, on the other hand.

Figure 5:
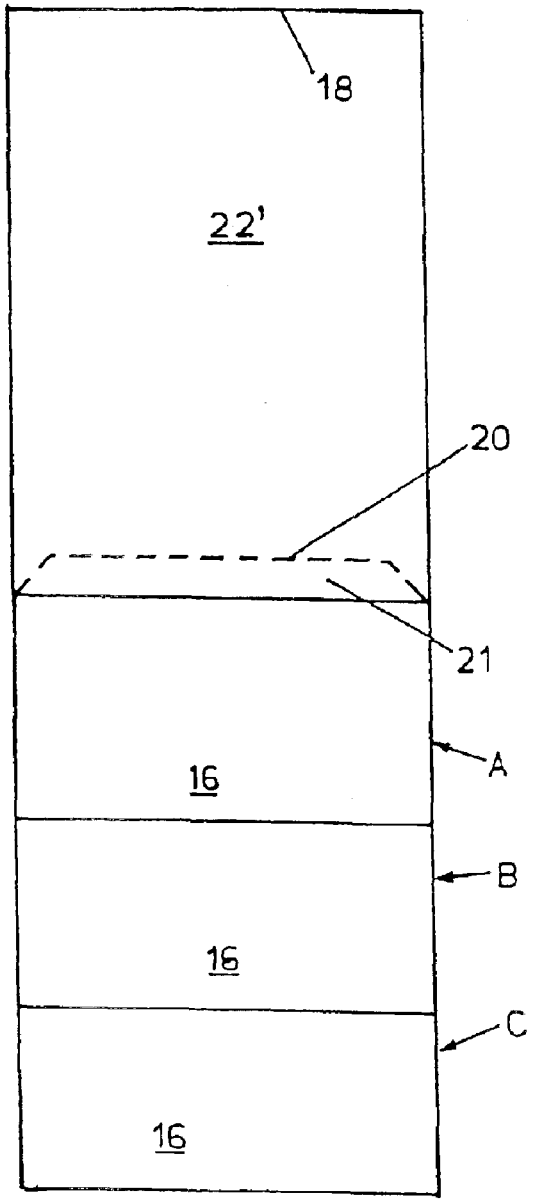
FIG. 5 represents three envelopes, according to the invention and a joint piece carrier.
Figures 6, 7:
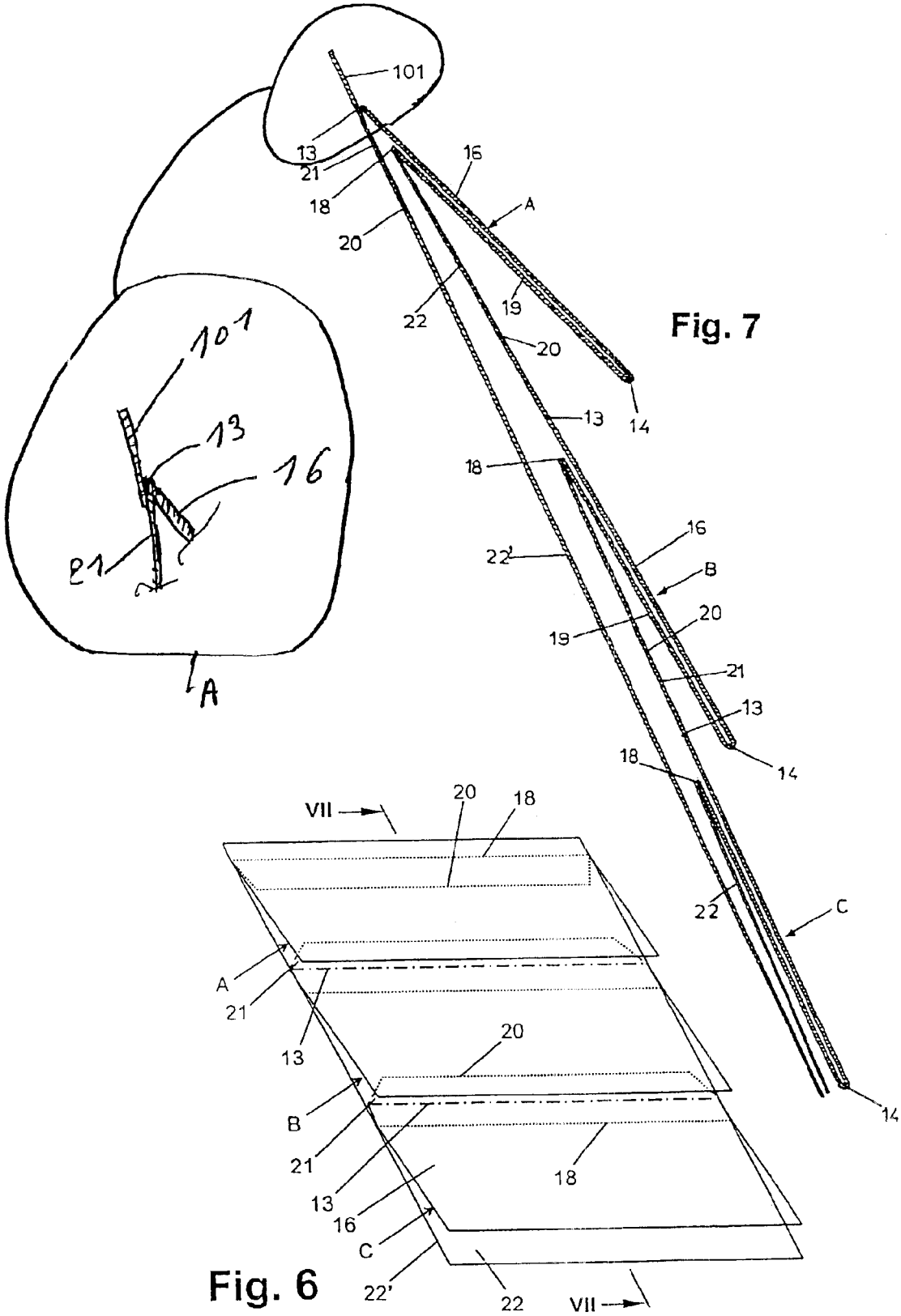
FIG. 6 provides a schematic perspective drawing of a joint piece carrier, according to the invention, with three envelopes.
FIG. 7 represents a cross section according to the line VII—VII of FIG. 6.

This application is illustrated in FIGS. 5–8 through a strip of three consecutive envelopes A, B and C. Joint piece carrier 22', preceding envelope A, is lengthened to such an extent that, when closing flap 21 of envelope A is folded back, joint piece carrier 22' covers the whole back of the three envelopes A, B and C. This joint piece carrier 22' constitutes the said carrier discussed above and, thus, is attached to the other joint pieces 22 which link up at the back 19 of envelopes A, B and C. In FIG. 5, this joint piece carrier 22' is represented in a non-folded back position, together with the folded envelopes A, B and C. In FIG. 6, this application is drawn schematically in perspective, joint piece carrier 22', corresponding to envelope A, being folded back to meet the other joint pieces 22 of envelopes A, B and C. Further, joint piece 22, following envelope C, is about as broad as back 19 of this envelope C, in order for it to overlie this back after folding. FIG. 7 represents a cross-section of FIG. 6.

If joint pieces 22 are glued to joint piece carrier 22', as set out above, a unit, called envelope sheet, is formed. Subject to the dimensions and shape of the said basic form 12, this envelope sheet may assume all possible sizes. Thus, when indeed the appropriate dimensions are being applied, the envelope sheet may be given a DIN A4 format, which may be printed by every standard printer. Those envelope sheets may be put per batch in the printer they will automatically be picked up one by one and printed. This makes it possible to handle whole series of envelopes in an ordinary standard printer without any further investment being required. For a printer with a very sensible lifting mechanism, a strip of paper 101 as shown in the enlarged circle A of FIG. 7 is applied to the closing flap of the first envelope by non-permanent glue. Preferably, strip 101 should exceed the sheet by about 1 to 1.5 cm. It would be more appropriate to glue strip 101 to the beginning of joint piece carrier 22'.

When, on basic form 12, division lines 20 and folding and division lines 18 hold but at a few places, i.e., when, for instance, they have been well perforated two or three times for a distance of 1 cm, or are thus provided with a division strip, while the rest of those lines have been cut loose, this permits a great advantage in that the envelopes may be removed from the whole at one pull. Each one of the loose envelopes is fully finished.

Figure 8:
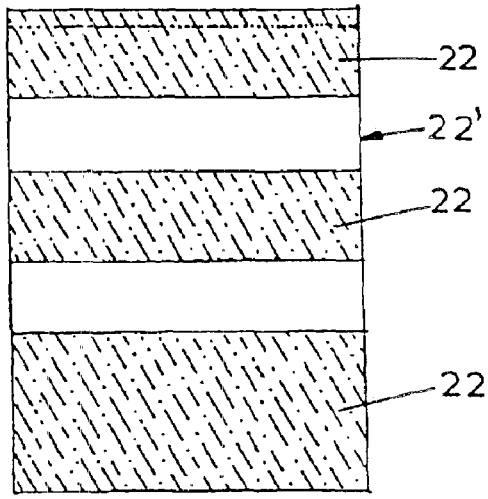
FIG. 8 schematically represents severed joint pieces.

The severing of the envelopes should be done as follows: the envelopes, the bases of which are held together, are taken firmly into one hand, while with the other hand the joint piece carrier 22' is gripped; then a short but fierce tug should be given. The envelopes then will be held in one hand, whereas all joint pieces 22 will be left on joint piece carrier 22'. FIG. 8 represents the removed joint pieces 22, the joint piece carrier 22' being shown cross hatched. Joint piece carrier 22' here constitutes a single page provided with the remaining joint pieces 22. Those joint pieces 22 may be filed, since, during printing, an identical reference as on the corresponding envelope may be applied to joint piece 22. Anyway, on single page joint piece carrier 22', the joints are glued in the right order of printing of the envelopes.

The envelope sheet, which has been described above, is made of the same kind of paper, since it is formed from a continuous strip of paper, and therefore may be relatively heavy. In order to make it lighter, joint piece carrier 22' can be reduced to a strip of about 1 cm as from the end of the closing flap 21 of the first envelope. A much lighter type of paper, for instance onionskin, may be glued to that bit, in order to return joint piece carrier 22' to its size as described above and to handle it further in the above-mentioned way.

As indicated above, FIG. 5 shows a joint piece carrier 22' preceding a first envelope A of three consecutive envelopes A, B and C. In this example, the joint piece carrier 22' serves as a common carrier to be attached to the joint pieces 22 of the three envelopes as shown in FIGS. 5–8.

In the embodiment of FIG. 5, the three consecutive envelopes A, B and C on the joint piece carrier 22' can be dimensioned to form a combination which has a Din-A4 or other format which permit printing on the envelopes A, B and C in conventional printers.

It is further possible to make the combination of joint piece carrier and envelopes in a Din-A4 (or other) format wherein the envelopes to be printed are either smaller or larger than the envelopes A, B and C of FIG. 5.

Figure 5A:
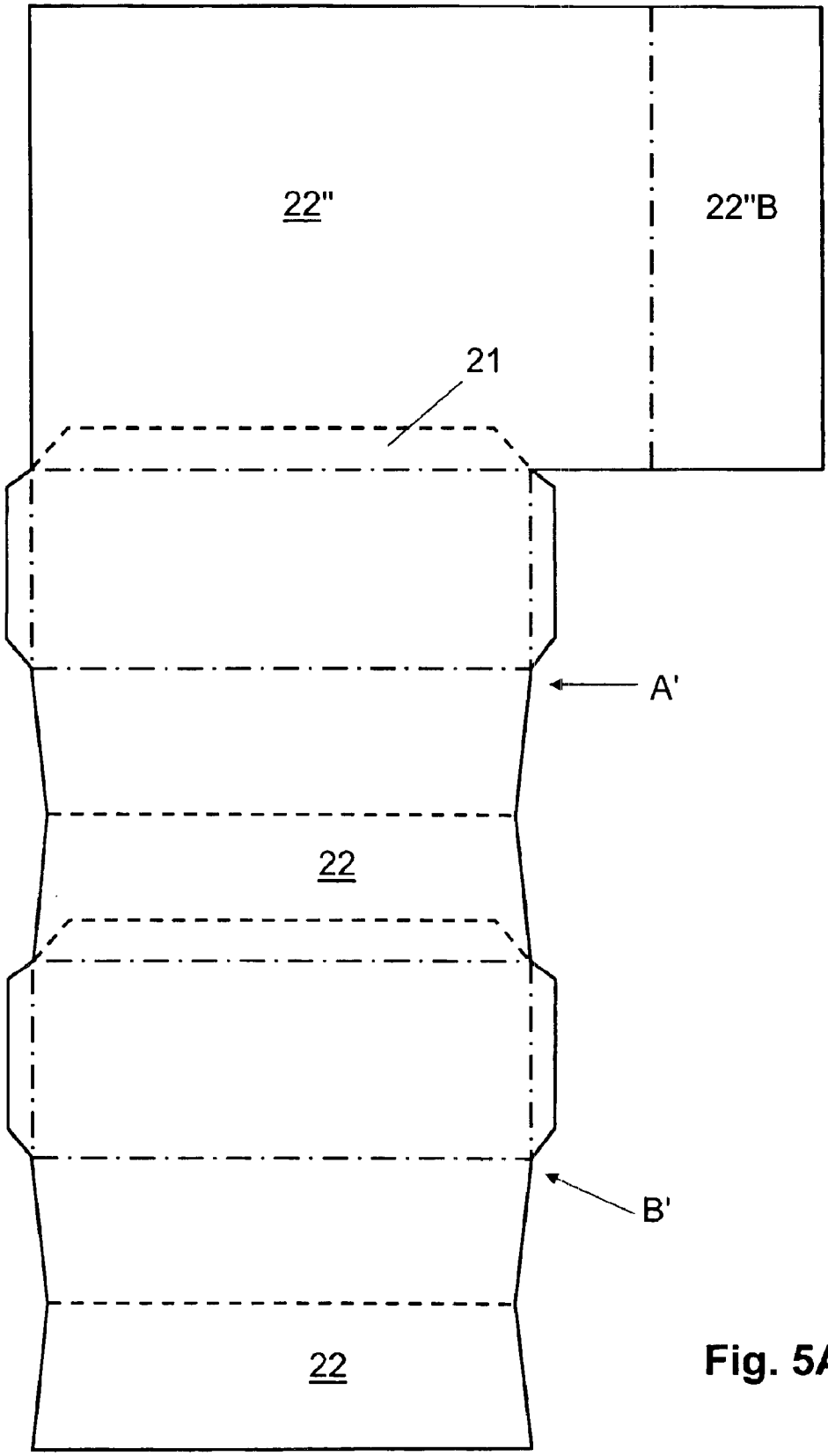
FIGS. 5A–5C show a second embodiment of the invention shown in FIG. 1.
Figure 5C:
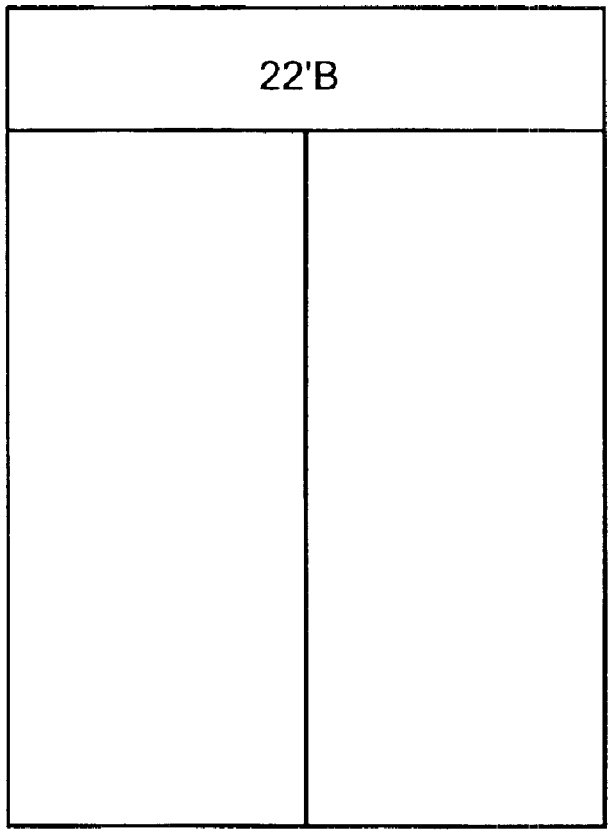
Figure 5B:
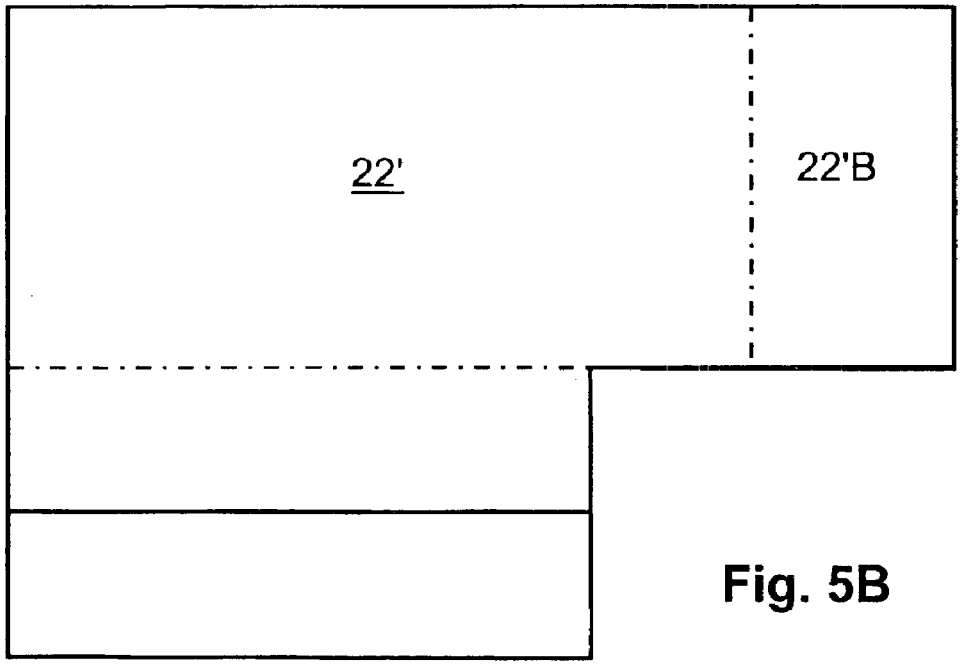

With regard to such larger envelopes, FIG. 5A shows a strip of two consecutive envelopes A' and B' which are larger than envelopes A and B of FIG. 5, engaged to joint piece carrier 22". FIGS. 5B and 5C show that joint piece carrier 22" can be consecutively folded so as to produce the Din-A4 (or other) format shown in FIG. 5C. This will allow envelopes A' and B' to be printed in a conventional printer which has been programmed for the larger envelopes in the same manner as the envelopes A, B and C of FIG. 5. This is accomplished by making joint piece carrier 22" broader than the breadth of envelopes A' and B'. Thus, when joint piece carrier 22" is glued on the joint pieces 22 of envelopes A' and B' in a manner similar to FIG. 7, it not only covers the whole back of the two envelopes A', B' but extends beyond the envelopes. An extended part 22"B of joint piece carrier 22" can then be folded back and glued in a way that covers a portion of the front sides of envelopes A' and B' as shown consecutively folded in FIGS. 5B and 5C as the Din-A4 or other format is produced.

Figure 5D:
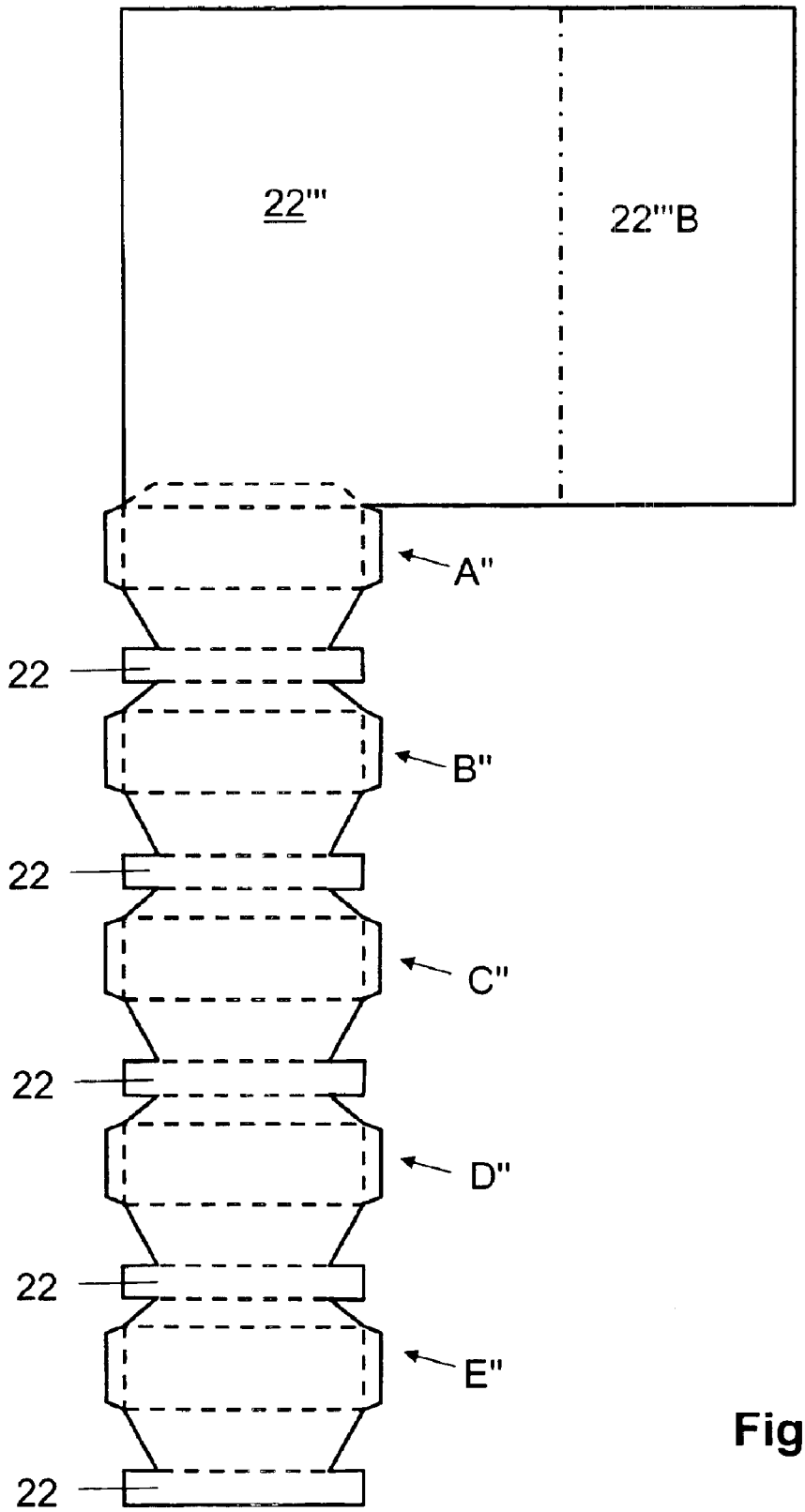
FIGS. 5D–5F show a third embodiment of the invention of the invention shown in FIG. 1.
Figure 5E:
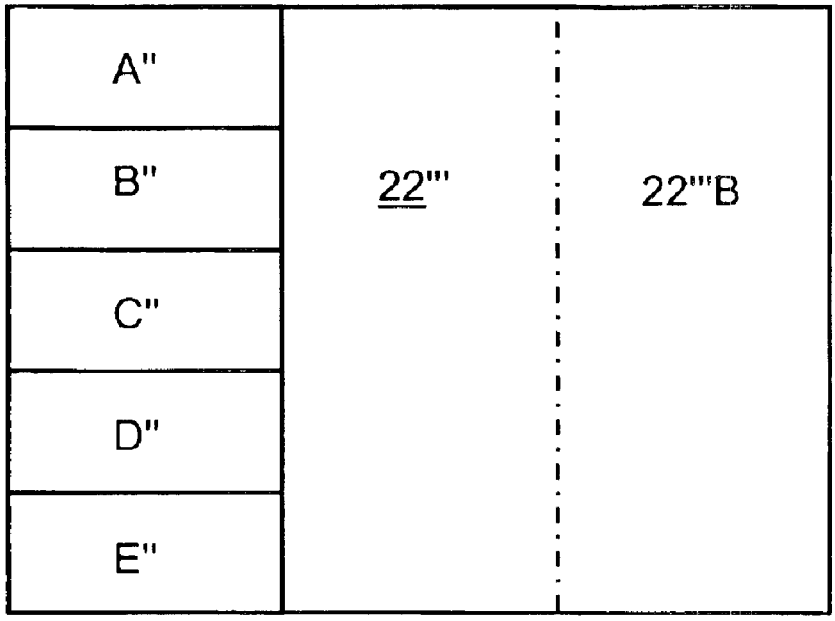

In a similar manner, envelopes smaller than those shown in FIG. 5 with a joint piece carrier 22" can be produced in a Din-A4 or other format for printing in conventional printers which have programmed for printing the smaller envelopes. FIG. 5D shows a series of five envelopes A", B", C", D" and E" engaged to joint piece carrier 22'". After the joint pieces 22 of the envelopes A'"–E'" have been glued to joint piece carrier 22'" as shown in FIG. 5E a portion 22'"B of joint piece carrier 22'" can be folded over the carrier 22'" to form the Din-A4 or other format shown in FIG. 5F.

Figure 5F:
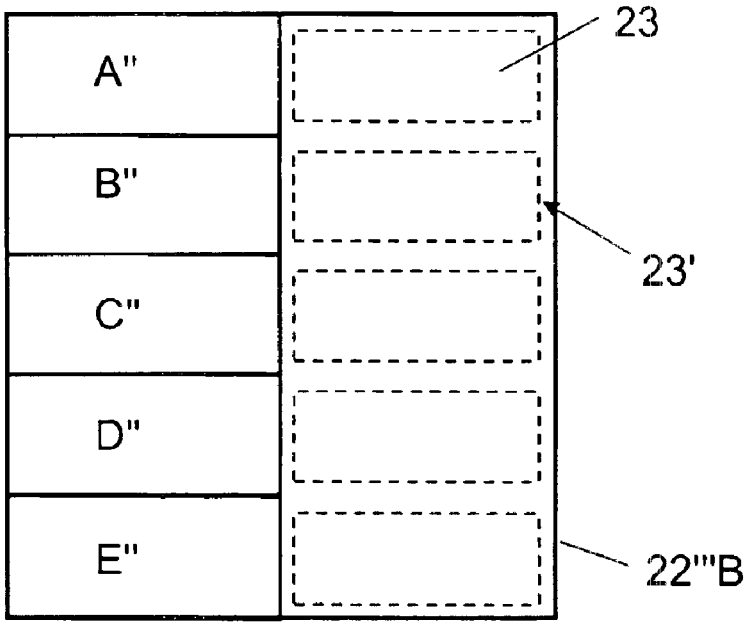

As shown in FIG. 5F, five cards 23 are formed on the infolded and glued portion 22'" which each can be fitted into each envelope A"–E". Rectangular perforation lines 23' through the glued together sheet, are shown on FIG. 5F which enable the cards 23 to be pushed out of such glued together sheets which is formed by the double layer of paper glued to each other so as to be stiff, in the same manner as a postcard. The perforations 23' are preferably formed after portion 22B'" is glued to piece 22'".

Figure 5G:
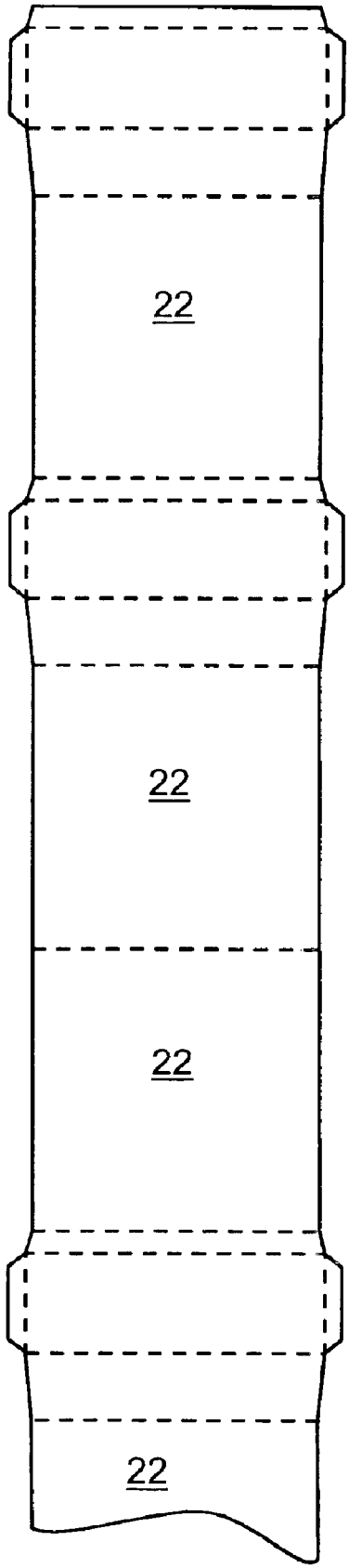
FIGS. 5G and 5H show a second embodiment of the joint pieces of FIG. 1.
Figure 5H:
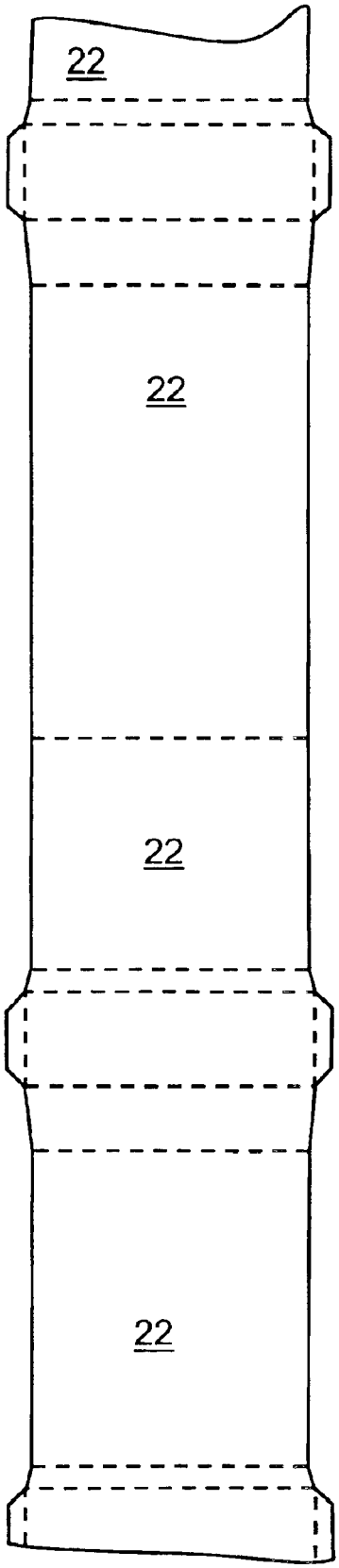

In still another embodiment of the invention, the joint pieces 22 may have different dimensions in the same continuous strip of material. This can be programmed in the machine manufacturing the continuous strip or in the printer itself. FIGS. 5G and 5H are directed to this embodiment wherein the joint pieces 22 are shown formed of one or more successive Din A4 pages which are detachably linked together. In the conventional home printer, the user can feed blank paper on a roll without having to provide the perforated and folding lines shown in FIG. 1. Forming the perforated and folding lines, gluing, printing and forming of the envelopes and the printed joint pieces are automatically completed by the printer which then ejects the envelopes from the printer, ready to be sent. Thus, the embodiment shown in FIGS. 5G and 5H permit uninterrupted printing and forming of personalized mail. Even individual envelope shapes can be crested in the same continuous strip while remaining interconnected. This embodiment accordingly makes real on line uninterrupted hybrid mail possible.

In this respect, the computer of a central machine can be controlled at distance by the computer of the user. As suggested above, the full automatic machine comprises a printing device for printing the letter and the address on the envelopes, a folding device, a separating device, a device for putting the printed letters (formed by the joint piece, which can be different for each envelope depending on the nature of the printed letters) into the envelopes, a device for closing the envelopes and a device for bringing a stamp on each envelope.

This central machine can be programmed so that it can be used by different users, for instance if such machine is placed in a secured place in Australia, users from the United States can send an order to this machine for printing and sending a letter to an address in Australia or another country.

Figure 5I:
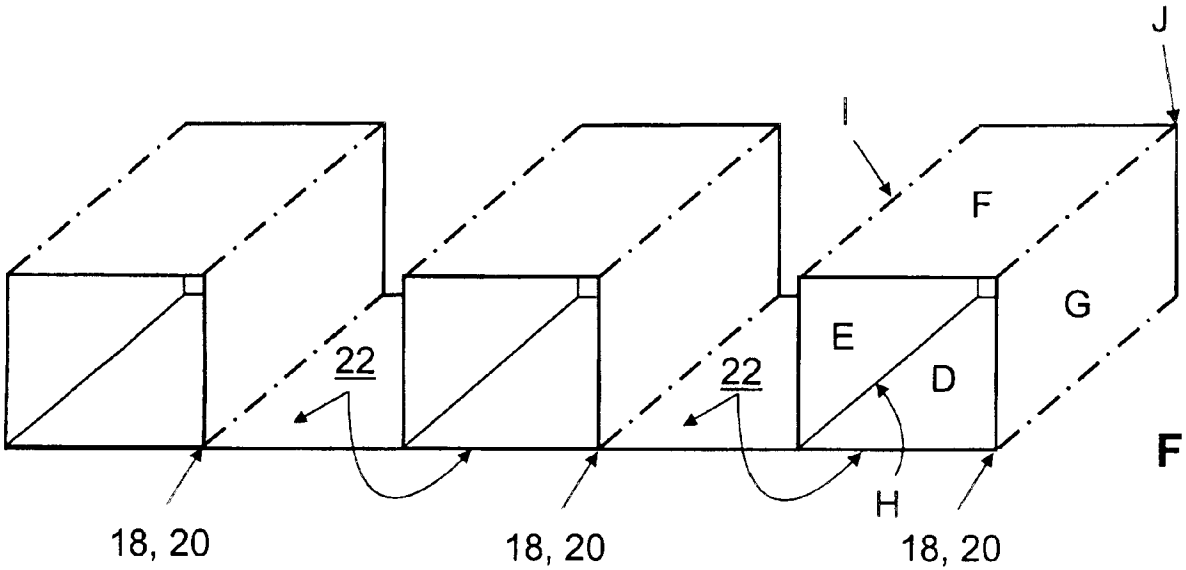
Figure 5L:
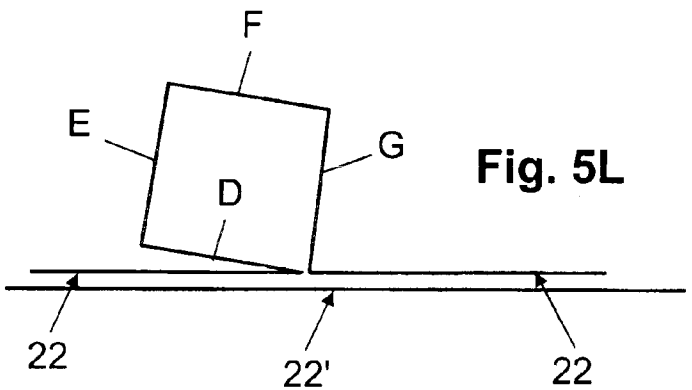
FIG. 5L shows a cross-section through the embodiment of FIG. 5L further showing a joint piece carrier.
Figure 5J:
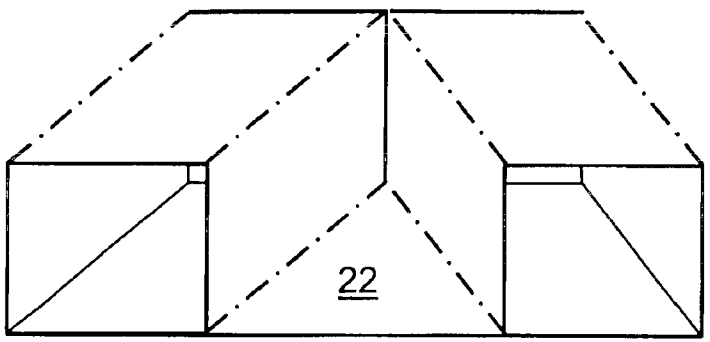
Figure 5K:
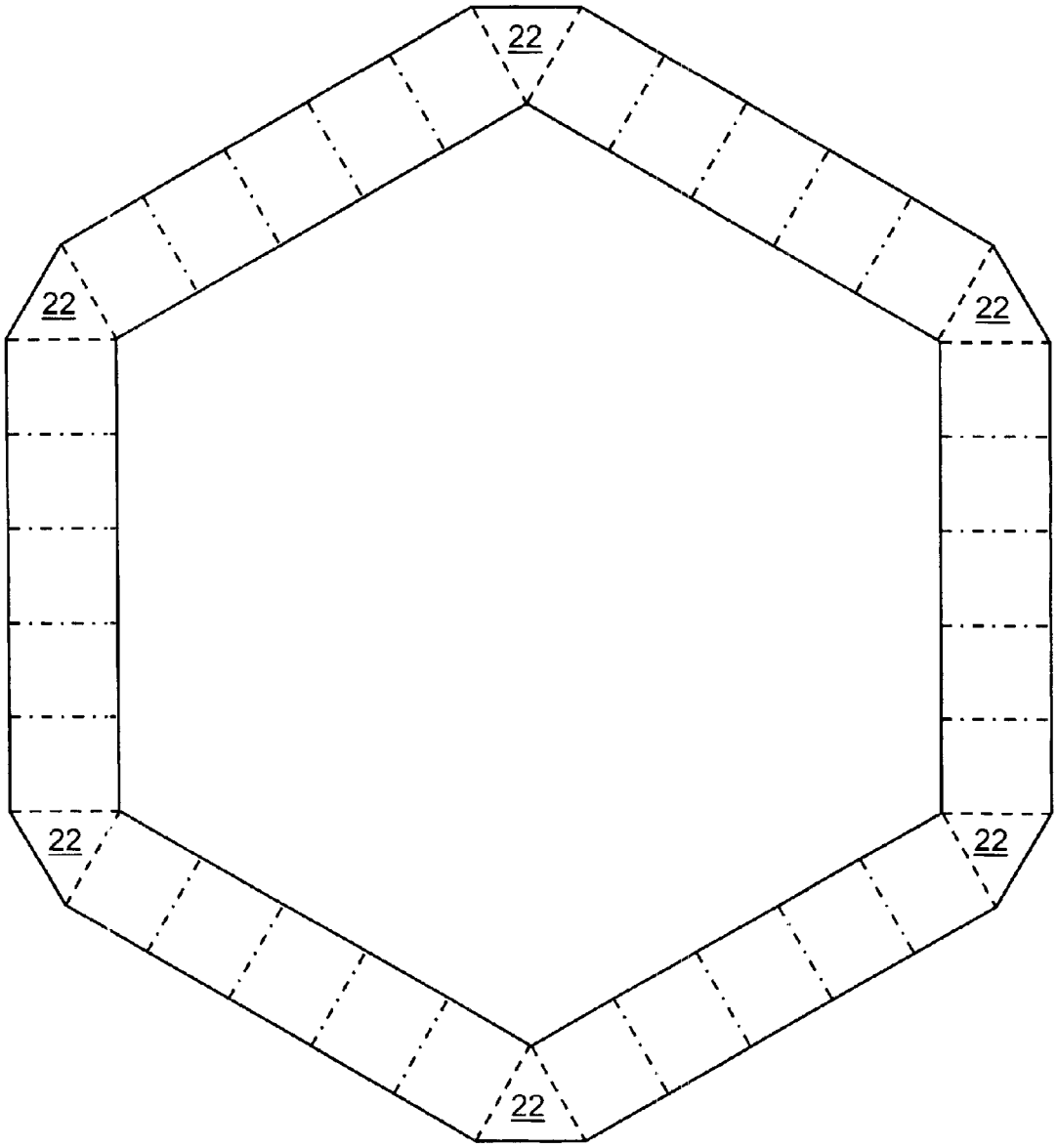
FIG. 5K shows a third embodiment of the joint pieces of FIG. 1.

In FIGS. 5I and 5J the products are shown to be boxes having four sides D, E, F and G foldable around folding lines H, I and J and engaged to joint piece 22 at division lines 18, 20. Thereafter, joint piece 22 is detachably engaged to joint carrier 22' as further shown in FIG. 5L. In still another embodiment of the invention, the joint pieces are not fixed between two successive products by parallel perforated lines. Thus, joint pieces can have any form such as the triangular form as shown in FIGS. 5J and 5K.

Figure 9:
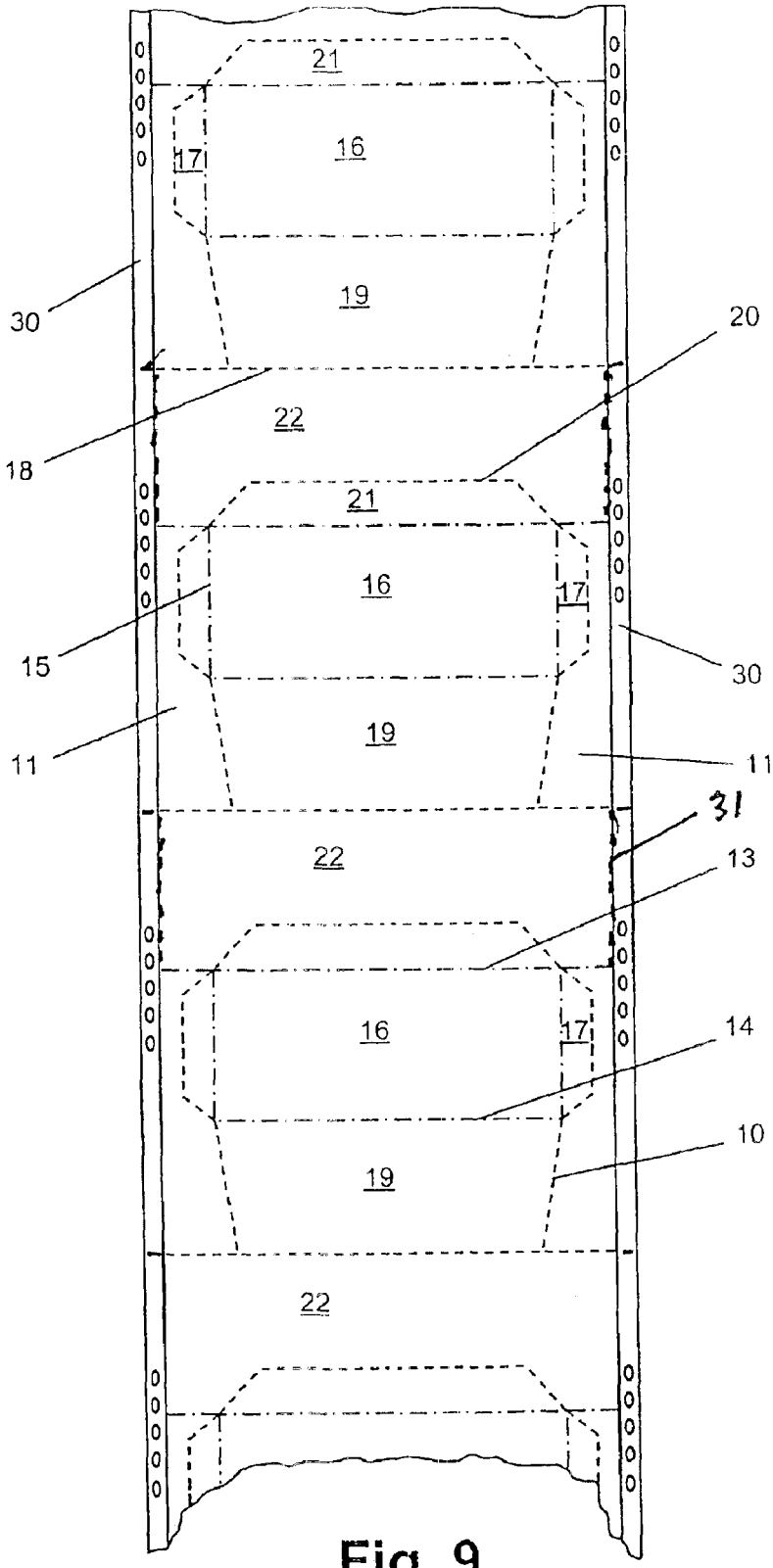
FIG. 9 provides a schematic plan view of consecutive series of areas of material provided with bands for pin-type feeding.

FIG. 9 is a plan view of an adjusted basic form of envelopes for pin-type feeding. Strips 30 shown in the drawing represents material to facilitate feeding which is severed along division lines 31 before the products are assembled. Apart from that, the process to attain the finished product is identical to the method described above.

The folding and division lines on the non-cut side bands 30 are also applied, so that they are folded up in the course of the actual forming of the envelopes.

In finishing this variant, an adhesive agent may be applied, on folding, to the places where the side bands 30 overlap or they may be connected in any other way. It would be proper to apply the perforations which must be provided for pin-type feeding devices, after the forming has been completed.

It is important that those side bands or transport bands 30 are only attached sideways to joint pieces 22, so that, when removing those bands 30, no traces of perforated lines are left on the sides of the envelopes.

Figure 10:
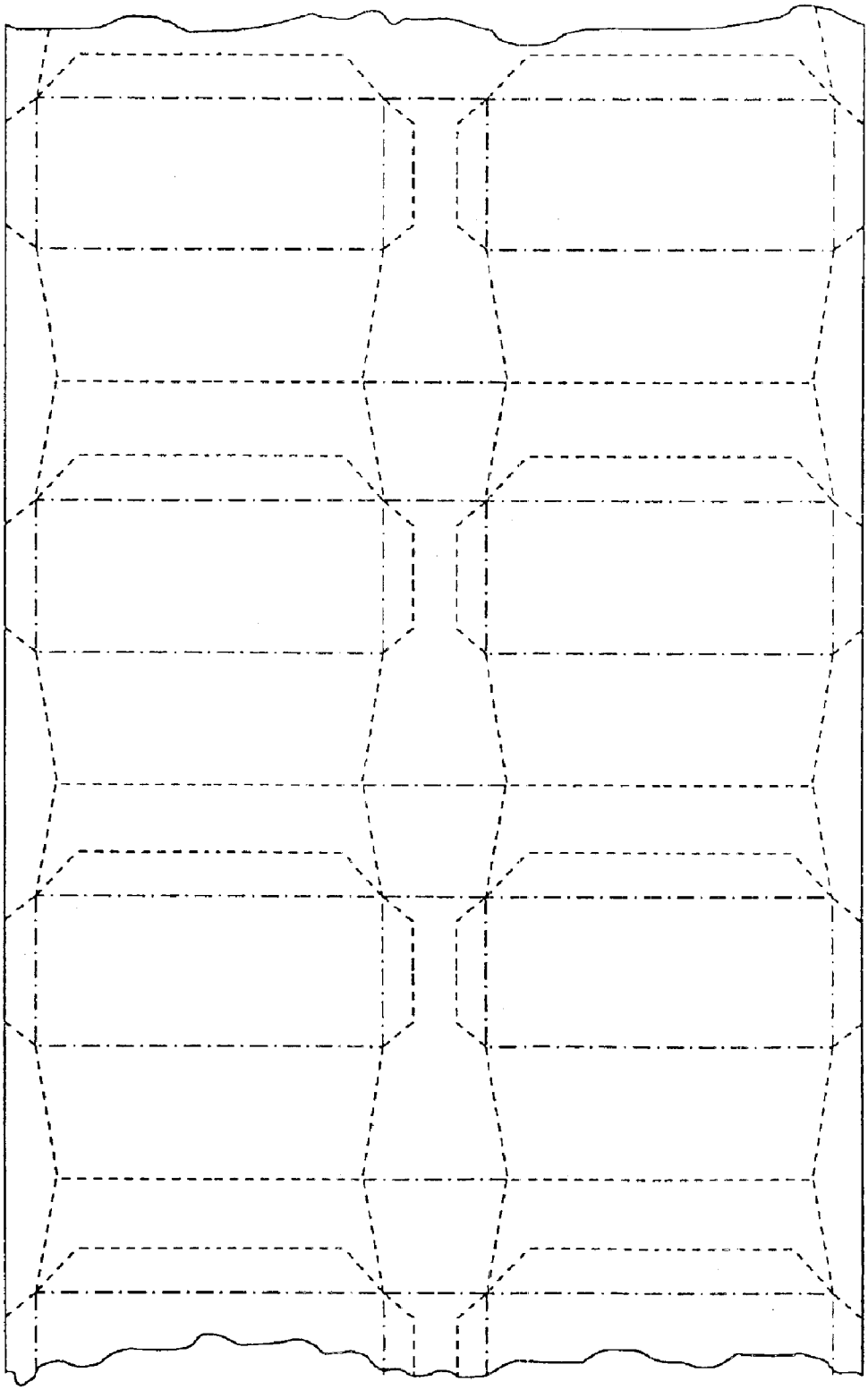
FIG. 10 represents a plan view of two parallel series of areas of material.

FIG. 10 shows a basic form 12 in which the envelopes are also 5 put horizontally next to each other, so that, at the constitution according to the process as described above, two envelopes are being shaped simultaneously. Per horizontal series, two in this drawing, it should be made sure that the side flaps 17 of each envelope are simultaneously folded inward and provided with adhesive agent 17' or a substitute adhesive. The procedure of FIG. 9 (pin-type feeding system) may or may not be applied to it. Possibly, more than two series of areas of material next to each other may be provided in one basic form 12.

When the strip of envelopes, according to the invention, is applied to printers using the standard DIN A4 format, irrespective of whether the paper input takes place through a paper tray, through a cutsheet feeder or page by page, the strip of paper (material) must be cut up (shaped) in pieces having a previously set length. The paper (material) treated according to the invention, thus, as a finished product, provides several envelopes the number of which differs according to the desired envelope format. More in particular, a format of a DIN A4 sheet, after the folding and shaping of basic form 12, is attained which may be applied to every printer using a DIN A4 format, if the basic form is given the proper dimensions. In view of the stepped production process, the format of the envelope and therefore the number of envelopes per individually finished envelope sheet, with already formed envelopes, may be adjusted by reducing or enlarging the joint piece 22.

An envelope which is severed from the sheet and which is closed (or is removed from the formed material), in spite of the production process according to which the envelopes (products) remain interconnected until the end use, is characterized by outlines which are intact and show no division marks whatsoever. Briefly, the end product is a fully-completed envelope.

As has been shown above, the strip, according to the invention, differs in many ways from the technical state of affairs of the patents U.S. Pat. No. 4,066,206 (PETERSON), FR-A-I 488 888 (GYSIN) and GB-A-567 924 (DAVIES).

The first two of those patents do indeed pertain to a continuous strip of envelopes, but the envelopes are put together as loose finished units, in view of constituting that strip. The envelopes of that strip, therefore, are not being formed from a continuous strip of paper.

In a first application of patent GB-A-567924 a strip of envelopes is being constituted out of a continuous strip of paper.

It should be pointed out that the said first application of this patent will still show division lines or cutting marks on the edges of the front side of the formed envelopes. Those lines result from removing the transport bands on severing the envelopes from the series. Even if those bands are at the sides of the back of the envelopes or at the sides of the closing flaps, the same problem will still arise.

Another drawback is the fact that those envelopes can only be severed one by one. No trace is left of the severed envelope, which may be used as a voucher to be filed. The continuous strip can only be applied to machines which are equipped with pin-type feeding.

The requirement to apply the labels later on, one by one, to the envelopes still is a time-consuming and little effective process. In addition, automatic envelope machines still not only have trouble in coping with labeled envelopes, but also with window envelopes, which did provide a solution through skipping the stage of the separate addressing of the envelopes. Using labels or window envelopes then generally results in putting the items to be sent or to be distributed in the envelope by hand. The invention provides a solution to the above-mentioned problem. The end user can also print series of envelopes through his own printer, without this entailing any extra hardware expenses. He also still has a filing voucher per envelope, which holds an identification system. In some applications, still more extra information may be printed on this filing voucher. The invention also eliminates the sideways division lines at the front or the back of the envelopes, which were still apparent at envelopes that also were formed from a continuous strip of paper, while still being interconnected.

The technical problem the invention solves, is that the separate envelope may be formed from a continuous strip of paper and remains interconnected, while, in spite of that characteristic, it is being made fully ready for use and finished without there being any division lines or cutting marks on the edges of any part of the envelope. This is possible through leaving the chosen basic forms of the envelopes interconnected by means of a joint piece which, even after the forming of the finished product, is preserved as a joint piece.

What is claimed is:

1. A method for forming a plurality of envelopes from a continuous strip of material comprising the steps of:

programming a printer to accept a continuous strip of material;

thereafter providing division lines on the continuous strip of material defining a plurality of consecutive areas of material to be formed as the envelopes and joint pieces respectively detachably interconnecting the consecutive areas;

forming the joint pieces as one or more successive pages which are detachably linked together, wherein each of the joint pieces between the consecutive areas has a programmed length along a longitudinal length of the strip corresponding to a different length letter to be printed on successive joint pieces of said strip;

simultaneously printing the consecutive areas of material and the joint pieces;

providing folding lines on each of said consecutive areas of material to define a closing flap, a front and a back of the envelope to be formed;

folding each of said consecutive areas of printing along the folding lines to form printed envelopes;

separating printed joint pieces which form different length letters having separated pages from the printed envelopes; and inserting the letters into the printed envelopes.

2. The method according to claim 1, wherein the front of the envelope has flaps which are glued inside the envelope to an inside face of the back of the envelope.

3. The method according to claim 1, wherein said pages constitute letters that are inserted into the envelope after being detached from the products and from themselves.

4. The method according to claim 1, wherein the printed envelopes are closed and stamped after inserting the letters into the printed envelopes.

5. The method according to claim 1, wherein said step of providing folding lines is carried out before or after said step of simultaneously printing.

* * * * *